United States Patent [19]

Fein

[11] Patent Number: 4,965,484

[45] Date of Patent: Oct. 23, 1990

[54] VAPOR DISCHARGE LAMP WITH GRADIENT TEMPERATURE CONTROL

[75] Inventor: Michael E. Fein, Mountain View, Calif.

[73] Assignee: Tencor Instruments, Mountain View, Calif.

[21] Appl. No.: 322,080

[22] Filed: Mar. 10, 1989

[51] Int. Cl.[5] ..... H01J 61/30; H01J 61/20; H01J 61/52

[52] U.S. Cl. ..... 313/15; 313/44; 313/46; 313/634; 313/611

[58] Field of Search ..... 313/612, 611, 15, 44, 313/46, 634

[56] References Cited

U.S. PATENT DOCUMENTS

| | | | |
|---|---|---|---|
| 2,629,836 | 2/1953 | Deri | 313/44 |
| 4,024,431 | 5/1977 | Young | 313/15 X |
| 4,074,163 | 2/1978 | Van der Leeuw | 313/13 |
| 4,095,142 | 6/1978 | Murayama et al. | 313/25 X |

*Primary Examiner*—Palmer C. DeMeo

*Attorney, Agent, or Firm*—Thomas Schneck

[57] ABSTRACT

An end-viewed vapor discharge lamp having a differential temperature control structure that removes heat more effectively from a base end of the lamp than from the light emitting output end of the lamp. The lamp envelope which contains an excitable vapor, such as mercury, includes a small bore capillary tube with a window at one end. A large bore extension contiguous with the capillary tube and a parallel second tube contain electrodes for providing a discharge in the capillary tube. A thermally conductive shell surrounds and is spaced apart from sides of the envelope and is partly filled with a thermally conductive material around the base end of the envelope. The output end around the capillary tube is free of this material. Heat conduction is better at the base end so that the capillary tube runs hotter, inhibiting condensation of vapor and giving a stable light output. An optional heater pad may be provided around the shell for maintaining an optimal temperature for maximum light output.

24 Claims, 1 Drawing Sheet

VAPOR DISCHARGE LAMP WITH GRADIENT TEMPERATURE CONTROL

TECHNICAL FIELD

The present invention relates to electric discharge lamps with temperature modifiers, and in particular to electric discharge lamps of the metal vapor type having double walls, jackets, casings and the like for modifying the temperature of the lamp envelope.

BACKGROUND ART

In the electric discharge lamp art it is well known that the performance of some discharge lamps can be enhanced by operating them at or near optimal temperatures. Accordingly, many lamps are provided with temperature modifiers of various types to hold them near the optimal operating temperatures. For example, fluid may be circulated in a casing surrounding a lamp envelope to cool the lamp. Alternatively, electric heaters or heat insulating jackets may be provided to operate the lamp at higher temperatures.

One type of discharge lamp that gives brighter light output at optimal temperatures is the low-pressure mercury discharge lamp. These lamps are widely used as light sources for optical instruments because of their availability and because of their bright 254 nm ultraviolet line. Optimizing the lamp temperature not only maximizes the intensity of the lamp output, but also makes the lamp output less sensitive to variations in temperature. Stable light output is a lamp characteristic which is important in many optical instrument applications. Each lamp design has a different optimal temperature, but it is not clear, a priori, what that temperature will be. Empirically, it is discovered that lamp output intensity is at a maximum when the lamp temperature is held near 40° C. for ordinary fluorescent room lighting lamps, and 60° C. for other lamps. The optimal temperature also depends in part on which spectral line or lines the optical instrument is to use.

In U.S. Pat. No. 4,074,163, Van der Leeuw discloses a gas-and-vapor discharge lamp having a discharge tube which is provided with a heat shield. The heat shield is connected to a bimetal element of the lamp such that, when the temperature of the discharge tube is raised or lowered, the shield is moved, respectively, further from or towards the discharge tube. Accordingly, the lamp reaches its optimal operating temperature rapidly after starting and temperature fluctuations during operation are small.

One problem associated with metal-vapor-type discharge lamps, such as the low pressure mercury discharge lamp, is condensation of the metal on the envelope walls. It is common practice to provide mercury lamps with an excess of mercury liquid so that mercury will be available to make up any losses incurred through such processes as burial of mercury ions in the region or end near the cathode. Mercury's vapor pressure decreases approximately exponentially with a decrease in operating temperature. At 125° C., the vapor pressure of mercury is approximately one torr; at 100° C., 0.273 torr; at 60° C., 0.025 torr. If the temperature at any point on the wall of the tube decreases to below the point where the partial pressure of mercury equals the vapor pressure, condensation will occur at that point. In general, the vapor pressure everywhere in the tube will come to equilibrium with the coldest point on the tube envelope, and droplets of mercury will tend to collect at that coldest point on the envelope.

Condensation tends to obstruct light output, making the output intensity unstable. Condensation is particularly a problem for end-viewed lamps which are viewed through a window at an end of the lamp. Droplets of mercury may tend to condense on this window, making the output unstable. It is therefore of great importance to provide mercury discharge lamps which insure that mercury condensation will not harm the functioning of the lamp. One possible solution is to decrease the partial fill pressure of mercury for lamps intended to run at cooler temperatures. However, this limits the potential life of the lamp.

It is an object of the present invention to provide a vapor discharge lamp with support structure which operates at or near its optimum temperature without light-output-obstructing condensation.

It is another object of the present invention to provide a vapor discharge lamp having a temperature modifying structure such that the lamp operates at near optimum temperature and has substantially stable light output.

DISCLOSURE OF THE INVENTION

The above objects have been met with a vapor discharge lamp having a temperature modifying structure that removes heat from different portions of a lamp envelope at different rates to ensure that any condensation occurs away from useful light emitting areas of the envelope. The invention is based on the realization that condensation will occur, if at all, only at the coldest part of the lamp. By providing nonuniform heat removal, we can ensure that this coldest point is not in a region of the envelope from which useful light is emitted.

In an end viewed lamp, light produced in a small bore is emitted through a window at one end of the bore. A base portion of an end-viewed lamp generally contains electrodes and gas reservoirs, and, being located distal to the window, any light emitted near the base portion of the lamp is not used. By making cooling less effective at the window end than at the base, the window end can be made to operate hotter than the base, so that any condensation occurs near the base and not in the end of the bore near the window.

An end-viewed vapor discharge lamp, having an envelope with a light-producing bore, a transparent window at one end of the bore and a base containing an electrode at an opposite end of the bore, is provided with a differential cooling structure having thermally conductive potting material filling a space around the base portion of the envelope and a thermally conductive shell spaced from and substantially surrounding the envelope. The shell extends from the base to the neighborhood of the window, usually as far as the plane of the window itself and preferably beyond the plane of the window. The thermally conductive potting material and shell conduct heat effectively away from the base of the lamp, while the lack of potting material around the window end combined with the partial obstruction of radiative and convective cooling by the shell causes heat removal from the window end to be less effective. The window end runs hotter than the base, preventing unwanted condensation in the window end.

BEST MODE FOR CARRYING OUT THE INVENTION

Figure 2:
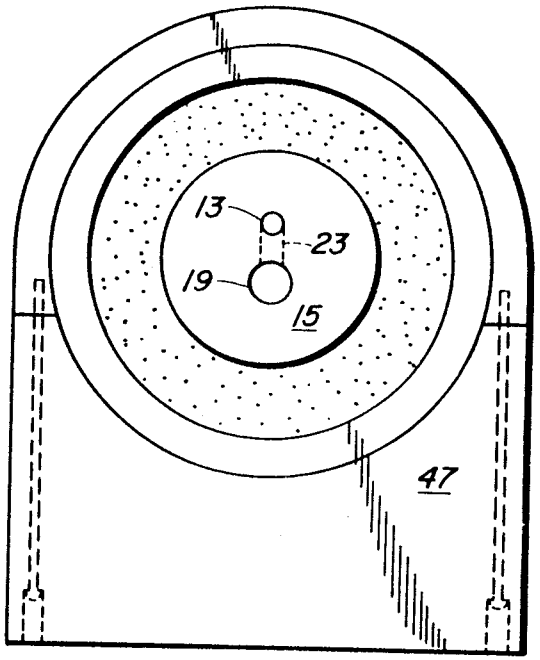
FIG. 2 is a front end view of the lamp and structure of FIG. 1.
Figure 1:
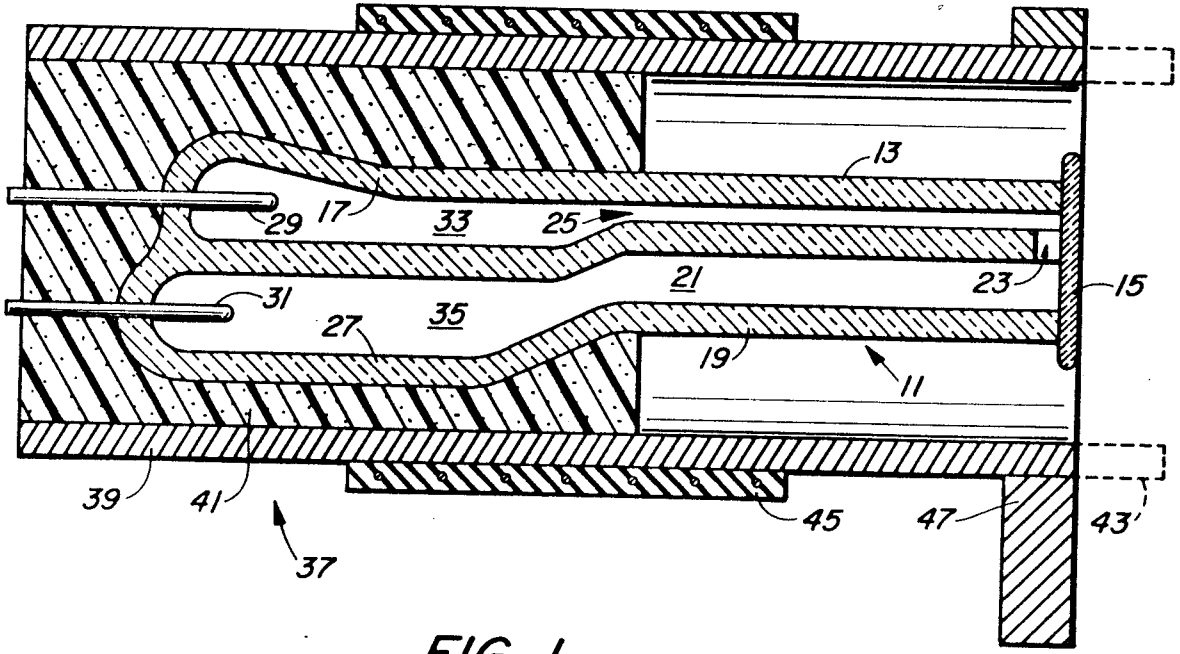
FIG. 1 is a side sectional view of a vapor discharge lamp with a differential temperature control structure of the present invention.

With reference to FIGS. 1 and 2, an end-viewed vapor discharge lamp with a differential temperature control structure that provides stable light output is seen. The lamp includes an elongated envelope 11 filled with an electrically excitable gas and vapor mixture. Typically, the lamp is a low-pressure lamp in which the envelope 11 is filled to less than atmospheric pressure. The actual filling pressure will vary for different envelope geometries and for the different gas and vapor mixtures with which envelope 11 may be filled.

However, for any given envelope and any given gas and vapor mixture, the optimum pressure can easily be determined experimentally with techniques known in the art. A preferred mixture is mercury vapor mixed with a buffer gas, such as argon. A typical optimum filling pressure for this mixture is estimated to be in a range on the order of 100 torr or less. The partial pressure of mercury vapor is typically one torr or less, depending in part on the desired operating temperature. Suitable means for optimizing a mixture's composition for maximum brightness at a particular wavelength or range of wavelengths of interest are known in the art.

The envelope 11 includes a small bore capillary tube 13 for supporting a main discharge of the excitable vapor, and a window 15 disposed at one end of capillary tube 13 defining a light emitting region of the envelope for observing therethrough incoherent light emitted by the vapor discharge. A preferred lamp is that described in Applicant's copending patent application Ser. No. 7/157,731, now U.S. Pat. No. 4,877,997, and by reference herein. While the present invention will also prevent condensation of the vapor on the light emitting envelope walls of a side-viewed lamp, improved output stability is particularly noticeable in end-viewed lamps, which tend to have much smaller emitting regions than side-viewed lamps.

Envelope material may include electrically insulative glasses, such as fused silica, or ceramics, such as alumina or beryllia. Form-grown sapphire, a monocrystalline material, may also be used. "Small bore" means that capillary tube 13 has a bore diameter not exceeding about 2 mm. It has been determined experimentally for bore diameters down to about 0.5 mm that the smaller the bore diameter, the brighter the light output, when filling pressure and operating current are optimized for each diameter. Preliminary indications for even smaller bore diameters are that the trend of smaller bore and brighter output may continue below 0.5 mm. Here the word "brighter" refers to the strict technical definition of brightness, which is emitted Watts/cm$^2$/steradian. Bore diameters for capillary tube 13 typically range from 0.1 mm to 2.0 mm.

Window 15 is typically a single, substantially planar piece of optical quality fused silica, although other materials can also be used. Window 15 must be substantially transparent to the wavelength or range of wavelengths of light which are of particular interest. For example, fused silica is transmissive for the 254 nm ultraviolet line emitted by mercury vapor discharges. Taken together, capillary tube 13 and window 15 define an output end of envelope 11.

Capillary tube 13 enlarges at a base end of envelope 11 opposite from the output end, i.e. at the nonviewing end furthest from window 15, to form a large bore extension 17 of tube 13 contiguous therewith. Envelope 11 also includes a second tube 19 defining a return path 21 parallel to capillary tube 13. A cross channel 23 is defined in the envelope's output end near window 15 that connects the main discharge bore 25 in capillary tube 13 with the return path 21 in second tube 19. Placing the cross-channel 23 as close as possible to window 15 minimizes the volume of cold gas outside of the discharge path and thereby avoids substantial reabsorption of the emitted discharge radiation. Having the cross-channel closely proximate to the window not only helps suppress reabsorption but is also helps to keep the window warm and suppress condensation. Second tube 19 typically has a larger bore diameter than capillary tube 13, preferably greater than 2.0 mm, though it can also have the same bore diameter. Making the bore diameter of second tube 19 larger than that of capillary tube 13 has the advantage of reducing starting and operating voltages below those which would be needed with equal bore lamps. The discharge in second tube 19 is of lower intensity, and is usually not viewed. Second tube 19 may also enlarge at the base end to form a large bore extension 27.

A pair of spaced apart electrodes 29 and 31 are hermetically sealed through envelope 11 at the base end. Electrode 29 is contained in an electrode volume 33 defined by large bore extension 17 of capillary tube 13, while electrode 31 is contained by a separate electrode volume 35 defined in the extension 27 of second tube 19. Hermetic sealing prevents the gas mixture from leaking. In the simplest configuration, the electrodes which provide the discharge have extensions through the envelope 11 which are sealed directly to the envelope material. Alternatively, lead-ins or supports sealed to envelope 11 may be provided and the electrode extensions welded or otherwise fixed to the supports. Electrodes 29 and 31 electrically connect the interior of envelope 11 containing the excitable gas-vapor mixture to an exterior power supply for producing an electrical discharge in bore 25 of capillary tube 13 in the path between the electrodes 29 and 31. The power supply can be either an AC or DC supply, and the voltage and current are selected experimentally to optimize brightness of the lamp output. A typical optimum current is on the order of 30 milliamps.

To maintain the operating temperature of the discharge in bore 25 of capillary tube 13 at an optimum temperature that maximizes output, while preventing condensation of the vapor in bore 25, a differential temperature control structure 37 is provided around the lamp envelope 11. Because condensation occurs at the coldest part of the lamp, the temperature control structure 37 maintains a higher temperature in the light emitting region of the envelope than in at least one other region in the envelope. To accomplish this objective, structure 37 is a nonuniform or differential cooling structure that removes heat more effectively from the base end of the envelope furthest from the window 15 than the light emitting output end nearest window 15.

This differential heat flow is provided by a thermally conductive shell 39 spaced apart from and substantially surrounding the sides of envelope 11 and partly filled with a thermally conductive filler material 41 in the space between envelope 11 and shell 39. Shell 39 is typically a rigidly supporting substantially cylindrical aluminum tube. Shell 39 typically has an outside diameter of about 19 mm and a thickness of 1.5 mm and is spaced approximately 2 mm from the outside diameter of the dual tube envelope 11. Filler material 41 is typically a polymerized elastomeric resin mixed with a dispersion of thermally conductive powdered inorganic filler. Such materials are commercially available, e.g. SC104 made by Thermoset Plastics, Inc., of Indianapolis, Ind.

Filler material 41 fills the space around the base end of the envelope, while the space surrounding the capillary tube 13 and window 15 is free from the thermally conductive material. For example, a typical lamp envelope is approximately 9 cm long and consists of a 1.25 to 1.5 cm long capillary tube 13, a 1.25 to 2.5 cm tapered transition region between tubes 13 and 15 and large bore tube extensions 17 and 27, and a 5 to 6.5 cm long base end consisting of tube extensions 17 and 27. Filler material 41 fills the space between shell 39 and envelope 11 except for the last 1.25 to 1.5 cm of that space so that there is no filler in the region surrounding the entirety of capillary tube 13 and window 15. The latter are surrounded only by air.

Heat removal from the base end is primarily due to conduction through filler material 41 to shell 39, then by a combination of radiation, air conduction, metal conduction and convection from shell 39 to the outside environment. Conductive heat removal from the output end is much smaller, and the heat removal is principally due to radiation with some air convection to shell 39, then from shell 39 to the external environment. As mentioned above, filler material 41 is typically an elastomeric polymer with dispersed inorganic power. One suitable composition is two parts silicone rubber mixed with a dispersion of one part powdered talc. Silicone rubber has a thermal conductivity that varies with composition but is typically about $$8\times10^{-4}\ (\text{cal/cm}^2\text{-sec})/(^\circ\text{C/cm}).$$

This is about ten times more conductive than air, which at 100° C. has a conductivity of $$7.4\times10^{-5}\ (\text{cal/cm}^2\text{-sec})/(^\circ\text{C/cm}).$$

Inorganic fillers, such as talc, have conductivities which are typically in the range $$(3\text{ to }10)\times10^{-3}\ (\text{cal/cm}^2\text{-sec})/(^\circ\text{C/cm}),$$

and are added to further increase the conductivity of filler material 41. Alternative embodiments will be apparent to persons skilled in the art by viewing the filled shell as comprising two materials, material 41 and air, with substantially different thermal conductivities, a highly conductive material around the base end and a low conductive material around the output end.

Shell 39 preferably extends at least as far as the plane of window 15, as seen, and inhibits convective flow of air about the output end of the envelope. Flow can be further inhibited by extending shell 39 beyond window 15, as indicated by the phantom extension 43. Radiation of heat from shell 39 may be retarded, if desired, by making it reflective to the infrared wavelengths (about 7 to 10 microns) of the radiated heat from envelope 11, i.e. by making the shell reflecting instead of absorbing. By Kirchoff's law, shell 39 would then have low emissivity for heat radiation.

The resulting operating temperature is typically about 10°-100° C., preferably about 60° C. for the small bore capillary tube lamps described in Applicant's copending patent application Ser. No. 07/157,731 and above with reference to FIG. 1, as measured at a point on the shell in good thermal contact with the base of the envelope. Typically, the capillary tube 13 runs about 10° C. hotter than the base end. Other lamp envelopes would have other optimal temperatures. To obtain a more stable temperature, a thermistor or other temperature sensor, not shown, may be placed on the envelope at some point and a heater pad 45 may be disposed around shell 41. Heater pad 45 is typically a silicone-rubber-insulated pad with embedded heater wires connected to a variable power supply. Whenever the measured temperature indicated by the thermistor falls by some predetermined amount below a temperature that corresponds to the optimal temperature for the capillary tube, an electronic control system, not shown, would turn on the heater pad 45. Such a servo control is well known in the art and is optional. The heater pad 45 would be used to heat up the lamp when it is first turned on to bring it quickly up to optimal temperature, and at partial power to raise or lower the temperature as needed to maintain optimal temperature. The system would usually be made so that, on average, only a portion of the heater pad's total heat output capability is needed to maintain the lamp at optimum temperature, and so that electrical power supplied to the pad can be varied as needed without exceeding the pad's limits.

The lamp, with its stable output due to operation at or near optimal temperatures and its condensation-inhibiting temperature control structure, is especially useful as a light source in optical instruments. It is to be understood that though the shell 39 is purposely heated above room temperature, the temperature differential between shell 39 and the envelope 11 still causes heat to be removed from the envelope 11, and that the heat removal is greater from the base portion of the envelope 11, which is in good thermal contact with the shell, than from the window end of the envelope 11. The lamp can be mounted to such an instrument with a low thermal conductivity, and preferably substantially non-conductive, carrier 47 secured to the outside of shell 39. Carrier 47 may be constructed of stainless steel which has a conductivity of $$0.11\ (\text{cal/cm}^2\text{-sec})/(^\circ\text{C/cm}),$$

about one-fifth that of the aluminum shell 39. The low thermal conductivity of carrier 47 enables the lamp to be brought to the desired temperature with only a modest amount of conductive heat loss from shell 41 through carrier 47.

I claim:

1. An end-viewed vapor discharge lamp comprising, a lamp envelope containing a volume of excitatable vapor, said envelope having a small bore capillary tube and a transparent planar window on one end of said capillary tube, said capillary tube and said window together defining an output end of said envelope, said window defining a light emitting surface region of said envelope, said envelope further including a base portion of said envelope distal to said output end, said base portion having a larger bore than said capillary tube and in communication with said capillary tube, means for producing an electrical discharge in said small bore capillary tube, whereby said vapor is excited to produce light for emission through said window, and differential temperature control means positioned around said envelope for maintaining a higher temperature in a first portion of said volume proximate to said light emitting surface region than in at least one other volume portion within said envelope, whereby condensation of vapor on said window is prevented.

2. The lamp of claim 1, wherein said differential temperature control means comprises non-uniform means for removing heat from said envelope, said non-uniform means removing heat more effectively from said at least one other volume portion than from said first volume portion.

3. The lamp of claim 1, wherein said differential temperature control means maintains hottest temperatures in said envelope in a neighborhood of said window and maintains coolest temperatures in said base portion of said envelope.

4. An end-viewed vapor discharge lamp comprising, a lamp envelope containing an excitable vapor, said envelope including a small bore capillary tube and a transparent planar window on one end of said capillary tube, said capillary tube and said window together defining an output end of said envelope, said window defining a light emitting surface region of said envelope, said envelope further including a base portion of said envelope distal to said output end, said base portion having a larger bore than said capillary tube and in communication with said capillary tube, means for producing an electrical discharge in said small bore capillary tube, whereby said vapor is excited to produce light for emission through said window, and a differential cooling structure having thermally conductive material filling a space around said base portion of said envelope and a thermally conductive shell, a second substantially less conductive material surrounding sides of said output end of said envelope, said shell substantially surrounding sides of said envelope spaced apart from said envelope, said shell extending from said base portion to said output end in the neighborhood of said window, whereby said shell inhibits convective flow about said output end of said envelope.

5. The lamp of claim 4, wherein said second material is air.

6. The lamp of claim 4, wherein said shell is reflective of radiated heat from said envelope.

7. The lamp of claim 4, wherein said small bore capillary tube has an operating temperature that maximizes light output through said window.

8. The lamp of claim 4, further comprising means for measuring an operating temperature at a point on said shell and means disposed around said shell for heating said shell whenever said measured operating temperature falls a predetermined amount below a temperature corresponding to an optimal temperature for said small bore capillary tube.

9. The lamp of claim 4, further comprising low thermally conductive means for mounting said shell to an optical instrument.

10. The lamp of claim 4, wherein said thermally conductive material filling said space comprises a polymerized elastomeric resin with a dispersion of thermally conductive powdered inorganic filler.

11. The lamp of claim 4, wherein said shell comprises a substantially cylindrical aluminum tube.

12. The lamp of claim 4, wherein said envelope contains mercury vapor mixed with a buffer gas.

13. An end-viewed low-pressure vapor discharge lamp comprising, an elongated envelope including a small bore capillary tube and a second tube defining a return path parallel to said capillary tube, said second tube being in communication with said capillary tube, via a cross-channel defined near an end of said envelope, an electrically excitable vapor in said capillary tube, a substantially planar transparent window disposed on said end of said capillary tube near said cross-channel for observing therethrough light emitted by said excitable vapor, a pair of spaced-apart electrode means sealed hermetically through said envelope for producing a discharge through said capillary tube between said pair of electrodes, a thermally conductive shell surrounding sides of said envelope, spaced apart from said envelope, and extending from an end of said envelope furthest from said window to the opposite end at least as far as the plane of said window, and a thermally conductive material filling a space between said envelope and said shell at said end of said envelope furthest from said window, the space surrounding said capillary tube being free from said thermally conductive material.

14. The lamp of claim 13, further comprising means for measuring an operating temperature at a point on said envelope and means disposed around said shell for heating said shell whenever said measured operating temperature falls a predetermined amount below a temperature corresponding to an optimal temperature for said small bore capillary tube.

15. The lamp of claim 13, further comprising substantially thermally nonconductive means for mounting said shell to an optical instrument.

16. The lamp of claim 13, wherein said thermally conductive material filling said space comprises a polymerized elastomeric resin with a dispersion of thermally conductive powdered organic filler.

17. The lamp of claim 13, where said shell comprises a substantially cylindrical aluminum tube.

18. The lamp of claim 13, wherein said shell is reflective of radiated heat from said envelope.

19. The lamp of claim 13, wherein said excitable vapor is mercury vapor, said mercury vapor being mixed with a buffer gas.

20. The lamp of claim 13, wherein said small bore capillary tube has an operating temperature that maximizes light output through said window.

21. The lamp of claim 13, wherein said small bore capillary tube has a bore diameter in a range from 0.1 to 2.0 mm.

22. The lamp of claim 13, wherein said second tube defining said return path has a larger bore diameter than said small bore capillary tube.

23. The lamp of claim 13, wherein said envelope is composed of material taken from the group consisting of glass, fused silica, alumina, beryllia, and form grown sapphire.

24. The lamp of claim 13, wherein said pair of electrode means are located at said end of said envelope furthest from said window, one of said electrode means being in a large bore extension of said small bore capillary tube, the other of said electrode means being in said second tube.

* * * * *